US005571661A

United States Patent [19]

Ishige et al.

[11] Patent Number: 5,571,661

[45] Date of Patent: Nov. 5, 1996

[54] SILVER HALIDE LIGHT-SENSITIVE COLOR PHOTOGRAPHIC MATERIAL

[75] Inventors: Osamu Ishige; Takesi Nakamura; Naoki Sato; Yutaka Kaneko, all of Hino, Japan

[73] Assignee: Konica Corporation, Tokyo, Japan

[21] Appl. No.: 466,431

[22] Filed: Jun. 6, 1995

[30] Foreign Application Priority Data

Jun. 9, 1994 [JP] Japan ..... 6-127692

[51] Int. Cl.[6] ..... G03C 7/305

[52] U.S. Cl. ..... 430/544; 430/957

[58] Field of Search ..... 430/544, 957, 430/553, 555, 558

[56] References Cited

U.S. PATENT DOCUMENTS

| | | | |
|---|---|---|---|
| 2,298,443 | 11/1942 | Weissberger | 95/6 |
| 2,311,182 | 2/1943 | Bohn | 20/11 |
| 2,343,703 | 3/1944 | Porter et al. | 95/6 |
| 2,367,531 | 1/1945 | Salminen et al. | 95/6 |
| 2,369,489 | 2/1945 | Porter et al. | 95/6 |
| 2,395,826 | 3/1946 | Hill et al. | 23/14 |
| 2,407,210 | 9/1946 | Weissberger et al. | 95/6 |
| 2,423,730 | 7/1947 | Salminen et al. | 260/559 |
| 2,474,293 | 7/1949 | Weissberger et al. | 95/6 |
| 2,600,788 | 6/1952 | Loria et al. | 95/6 |
| 2,772,162 | 11/1956 | Salminen et al. | 96/55 |
| 2,875,057 | 2/1959 | McCrossen et al. | 96/100 |
| 2,908,573 | 10/1959 | Bush et al. | 96/100 |
| 3,002,836 | 11/1961 | Vittum et al. | 96/55 |
| 3,034,892 | 5/1962 | Gledhill et al. | 96/55 |
| 3,041,236 | 6/1962 | Stecker | 167/31 |
| 3,048,194 | 8/1962 | Huthsing, Sr., et al. | 137/630.15 |
| 3,062,653 | 11/1962 | Weissberger et al. | 96/100 |
| 3,152,896 | 10/1964 | Tuite | 96/22 |
| 3,265,506 | 8/1966 | Weissberger et al. | 96/100 |
| 3,447,928 | 6/1969 | Loria | 96/100 |
| 3,519,429 | 7/1970 | Lestina | 96/100 |
| 3,632,345 | 1/1972 | Marx et al. | 96/95 |
| 3,725,067 | 4/1973 | Bailey et al. | 96/56.5 |
| 3,928,041 | 12/1975 | Fujiwhara et al. | 96/66.3 |
| 3,958,993 | 5/1976 | Fujiwhara et al. | 96/66.3 |
| 3,961,959 | 6/1976 | Fujiwhara et al. | 96/66.3 |
| 4,248,962 | 2/1981 | Lau | 430/382 |
| 4,540,654 | 9/1985 | Sato et al. | 430/381 |
| 4,666,999 | 5/1987 | Cook et al. | 526/84 |
| 4,782,012 | 11/1988 | DeSelms et al. | 430/544 |

FOREIGN PATENT DOCUMENTS

| | | | |
|---|---|---|---|
| 0440466 | 8/1991 | European Pat. Off. | 430/544 |

*Primary Examiner*—Lee C. Wright

*Attorney, Agent, or Firm*—Finnegan, Henderson, Farabow, Garrett & Dunner, L.L.P.

[57] ABSTRACT

A silver halide light-sensitive color photographic materials is disclosed. The material comprises a compound which releases, upon reaction with an oxidation product of a color developing agent, a 2-mercapto-1,3,4-oxadiazole derivative represented by formula I:

I wherein $L_1$ represents a linkage or a divalent linking group; $R^1$ represents an alkyl group, an aryl group or a heterocyclic group; $R^2$ represents a hydrogen atom or a substituent; n represents an integer of one, two or three; and m represents an integer of zero, one or two, provided that sum of m and n is three.

The color photographic material produces a dye image having enhanced image-sharpness, showing large inter-image effect with reduced reduction of gamma in the layer, to which the coupler is incorporated and having improved stability with the lapse of time during storage.

3 Claims, No Drawings

SILVER HALIDE LIGHT-SENSITIVE COLOR PHOTOGRAPHIC MATERIAL

FIELD OF THE INVENTION

The present invention relates to a silver halide light-sensitive photographic material. Specifically, it relates to a silver halide light-sensitive color photographic material, of which photographic and preservation properties are improved.

BACKGROUND OF THE INVENTION

Recently, development of light-sensitive color photographic materials having enhanced sensitivity, sharpness and color reproduction property have strongly been demanded.

As means to improve sharpness, use of a DIR compound, or a development inhibitor releasing compound, which releases a development inhibitor upon reaction with an oxidation product of a color developing agent, is known. And it is well known in the art that improvement in the color reproduction is attained by the edge effect, by incorporating a DIR compound in the emulsion. However, in these DIR compounds, there was a problem that the development inhibitor diffuses into the processing solution from the light-sensitive photographic material and accumulates in it. As the result, the processing solution becomes to bear development inhibiting Couplers to solve this problem, various attempts have been made as disclosed in Japanese Patent O.P.I. Publications No. 57-151944(1982), No. 58-205150(1983), No. 60-218644(1985), No. 60-221750(1985), No. 61-11743(1986) and U.S. Pat. No. 4,782,012.

These couplers have development inhibiting property when released from the coupling position of the coupler, and after being effused into a processing solution, they are decomposed into compounds which have no influence on the photographic property. They are couplers having a releasing group of such nature, it is actually the case when a large amount of light-sensitive material containing this type of coupler is processed, desensitization and contamination of the processing solution were improved by the use of this coupler, however, light-sensitive materials comprising the above-mentioned coupler tends to cause increase of fog and deterioration in sensitivity, image sharpness and color reproduction. Moreover, considering the property as a coupler per se, edge effect and inter-image effect of this type of couplers are not yet sufficient.

SUMMARY OF THE INVENTION

The object of the present invention is to provide a silver halide light-sensitive color photographic material which produces a dye image having enhanced image-sharpness, showing large inter-image effect with reduced reduction of gamma in the layer, to which the coupler is incorporated and having improved stability with the lapse of time during storage.

The silver halide light-sensitive photographic materials of the present invention comprises a compound which is, upon reaction with an oxidation product of a color developing agent, releases a 2-mercapto-1,3,4-oxadiazole derivative represented by the following general formula I:

General Formula I

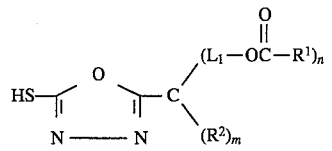

wherein $L_1$ represents a linkage or a divalent linking group; $R^1$ represents an alkyl group, an aryl group or a heterocyclic group; $R^2$ represents a hydrogen atom or a substituent thereof; n represents an integer of one, two or three and m represents an integer of zero, one or two, provided that sum of n and m is three.

DETAILED DESCRIPTION OF THE INVENTION

Hereinbelow, the present invention is explained in detail.

The 2-mercapto-1,3,4-oxadiazole can be released either directly from a coupler or indirectly through a timing group. As for such coupler residues, those that produce a yellow, magenta or cyan dye, and those groups that produce a substantially colorless product can be mentioned.

The compound of the invention is represented by a Formula:

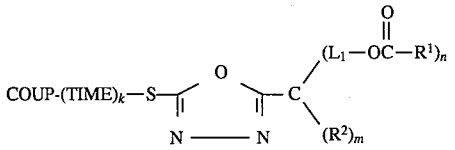

wherein COUP is a group coupling with a an oxidation product of a color developing agent, TIME is a group which releases 2-mercapto-1,3,4-oxadiazole derivative represented by formula I upon reaction that an oxidation product of a color developing agent couples with COUP, k is 0 or 1.

COUP and TIME are called a coupler residue and a timing group respectively hereafter.

A preferable coupler residue is a yellow, magenta or cyan dye forming coupler, and most preferably, a yellow and cyan coupler residue.

Representative yellow coupler residues are disclosed in, for example, U.S. Pat. Nos. 2,298,443, No. 2,407,210, No. 2,875,057, No. 3.048,194, No. 3,265,506 and No. 3,447,928; and on pages 112 through 126 of "Farbkuppler Eine Litera turuversiecht Agfa Nettling (Band II)(1961)), etc.

Among these compounds, acylacetanilide compounds such as benzoylacetoanilide and pivaloylacetanilide compounds are preferable.

Representative magenta dye-forming coupler residues are those disclosed in, for example, U.S. Pat. Nos. 2,369,489, No. 2,343,703, No. 2,311,182, No. 2,600,788 No. 2,908,573, No. 3,062,653, No. 3,152,896, No. 3,519,429, No. 3,725,067, No. 4,540,654; Japanese patent O.P.I. Publication No. 59-162548(1984) and on pages 126 through 156, in the above-mentioned "Farbkuppler eine litera turuversiecht Agfa Nitteilung (Band II) (1961)), etc. Among those, pyrazolone compounds and pyrazoloazole compounds such as pyrazoloimidazole, pyrazolotriazole, etc. are preferable.

Representative coupler residues of the cyan dye-forming coupler are disclosed in, for example, U.S. Pat. Nos. 2,367,531, No. 2,423,730, No. 2,474,293, No. 2,772,162, No. 2,395,826, No. 3,002,836, No. 3,034,892, No. 3,041,236, No. 4,666,999, and on pages 156 through 175 of the above-mentioned "Farbkuppler eine litera turuversiecht Agfa Nitteilung (Band II) (1961)), etc. Among these, phenol compounds and naphthol compounds are preferable.

Representative coupler residues which form substantially colorless products are disclosed, for example, in British Patent No. 861,138, U.S. Pat. Nos. 3,632,345, No. 3,928,041, No. 3,958,993 and No. 3,961,959. Among these cyclic carbonyl compounds are preferable.

The representative timing groups, include those compounds which release a photographically useful group by intramolecular nucleophilic substitution reaction as disclosed in, for example, U.S. Pat. Nos. 4,248,962 and Japanese Patent O.P.I. Publication No. 57-56837(1982).

Other than those mentioned above, Timing groups disclosed in Japanese patent O.P.I. publications No. 57-188035(1982), No. 58-98728(1983), No. 59-206834(19843), No. 60-7429(1985), No. 60-214358 (1985), No. 60-225844 (1985), No. 60-229030 (1985, No. 60-233649(1985), No. 60-237446(1985) and No. 60-237447(1985) can also be mentioned.

As for the yellow dye-forming coupler residue, those represented by the following formulae II and III are preferable:

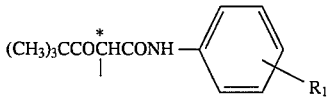

General Formula II

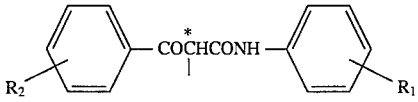

General Formula III

An asterisk (*) shows a coupling position with an oxidation product of a color developing agent.

In the above-mentioned general formulae, $R_1$ and $R_2$ independently represent, for example, an alkyl group, a cycloalkyl group, an aryl group, a heterocyclic group or a halogen atom and the above-mentioned alkyl group, cycloalkyl group, aryl group and heterocyclic group may be connected to the coupling position of the molecule through an oxygen atom, a nitrogen atom or a sulfur atom. Moreover, the above-mentioned alkyl group, cycloalkyl group, aryl group and heterocyclic group may be connected to the coupling position of the molecule through the following linking groups, i.e., a carbamoylamino group, a carbamoyl group, a sulfonamido group, a sulfamoyl group, a sulfamoylcarbonyl group, a carbonyloxy group, an oxycarbonyl group, a ureido group, a thioureido group, a thioamido group, a sulfon group, a sulfonyloxy group, etc.: Still further, the above-mentioned alkyl group, cycloalkyl group, aryl group and heterocyclic group may have a substituent mentioned below:

That is to say, the substituent includes, for example, a halogen atom, a nitro group, a cyano group, an alkyl group, an alkenyl group, a cycloalkyl group, an aryl group, an alkoxy group, an aryloxy group, an alkoxycabonyl group, an aryloxycarbonyl group, a carboxyl group, a sulfo group, a sulfamoyl group, a carbamoyl group, an acylamino group, a ureide group, a urethane group, a sulfonamide group, a heterocyclic group, an arylsulfonyl group, an alkylsulfonyl group, an arylthio group, an alkylthio group, an alkylamino group, an anilino group, an imide group, and an acyl group.

There may be a plurality of $R_1$'s and $R_2$'s.

When there are two or more of $R_1$'s or $R_2$'s, they may be either the same or different.

As for the magenta dye-forming coupler residue which is capable of releasing the compound represented by the general formula I, those represented by the following formulae IV, V, VI and VII are preferable,

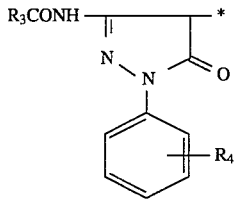

General Formula IV

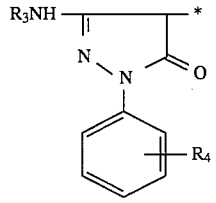

General Formula V

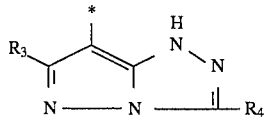

General Formula VI

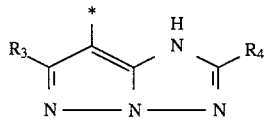

General Formula VII $R_3$ and $R_4$ in the above-mentioned general formulae IV through VII have the same definitions as $R_1$ and $R_2$ in the general formulae II and III, respectively.

As for the cyan dye-forming coupler residue which is capable of releasing the compound represented by the general formula I, those represented by the following formulae VIII, IX and X are preferable:

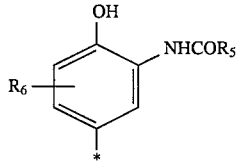

General Formula VIII

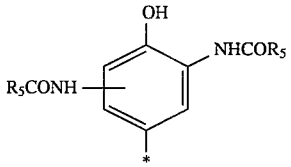

General Formula IX

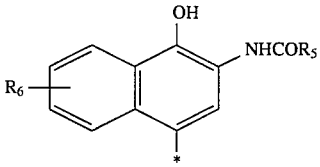

General Formula X

In the above-mentioned general formulae VIII through X, $R_5$ and $R_6$ have the same definitions as $R_1$ and $R_2$ in the general formulae II and III, respectively.

As for the colorless dye-forming coupler residue which is capable of releasing the compound represented by the general formula I, those represented by the following formulae XI, through XIV are preferable:

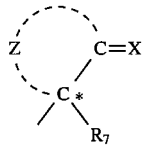

General Formula XI wherein $R_7$ represents, for example, a hydrogen atom, an alkyl group, an aryl group, a halogen atom, an alkoxy group, an acyloxy group or a heterocyclic group; X represents an oxygen atom or a group represented by $=NR_8$; $R_8$ represents an alkyl group, an aryl group, a hydroxyl group, an alkoxy group or a sulfonyl group: Z represents a group of non-metal atoms necessary to form a five- to seven-member carbon ring such as indanone, cyclopentane, cyclohexanone, etc. or a heterocyclic ring such as pyperidone, pyrrolidone, hydrocarbostyril, etc.;

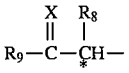

General Formula XII wherein $R_8$, X respectively have the same definitions as $R_7$ and X in the general formula XII; $R_9$ represents an alkyl group, an aryl group, a heterocyclic group, a cyano group, a hydroxyl group, an alkoxy group, an aryloxy group, a heterocyclicoxy group, an alkylamino group, a di-alkylamino group or an anilino group;

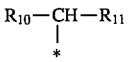

General Formula XIII wherein $R_{10}$ and $R_{11}$ may be either same or different and they independently represent, for example, an alkoxy group, a carbamoyl group, an acyl group, a cyano group, a formyl group, a sulfonyl group, a sulfinyl group, a sulfamoyl group or a group represented by:

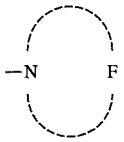

F represents a group of non-metal atoms necessary to form a five- to seven-member heterocyclic ring such as phthalimide, triazole, tetrazole, etc.

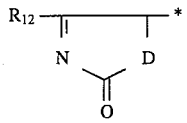

General Formula XIV wherein $R_{12}$ represents, for example, an alkyl group, an aryl group, an anilino group, an alkylamino group or an alkoxy group; D represents an oxygen atom, a sulfur atom, a hydrogen atom or a nitrogen atom having a substituent.

The most preferable examples of the coupler residue are those of Formula II and X.

When the compound represented by the general formula I is released indirectly through a timing group, the timing group includes those represented by the following general formulae XV, XVI and VII.

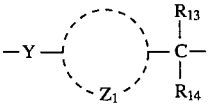

General Formula XV wherein $Z_1$ represents a group of atoms necessary to complete a benzene ring or a naphthalene ring, each of which may have a substituent.

Y represents —O—, —S— or —N($R_{15}$)— and is connected to the coupling position of the coupler residue; $R_{13}$, $R_{14}$, and $R_{15}$ independently represent a hydrogen atom, an alkyl group or an aryl group. The preferable Y is —O—. The preferable $R_{13}$ and $R_{14}$ is a hydrogen atom.

Moreover, —C($R_{13}$)($R_{14}$)— group is substituted at ortho- or para- position with respect to Y.

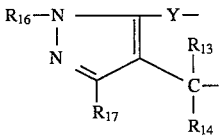

General Formula XVI wherein Y, $R_{13}$ and $R_{14}$ respectively have the same definitions as Y, $R_{13}$ and $R_{14}$ in the general formula XV; $R_{16}$ represents, for example, a hydrogen atom, an alkyl group, an aryl group, an acyl group, a sulfonyl group, an alkoxycarbonyl group, or a heterocyclic group; $R_{17}$ represents, for example, a hydrogen atom, an alkyl group, an aryl group, a heterocyclic group, an alkoxy group, an amino group, an amide group, a sulfonamide group, a carboxyl group, an alkoxycarbonyl group, a carbamoyl group or a cyano group. The preferable Y is —O—. The preferable $R_{13}$ and $R_{14}$ is a hydrogen atom. The preferable $R_{16}$ is an aryl group, and more preferably a nonsubstituted phenyl group and nitro-substituted phenyl group. The preferable $R_{17}$ is an alkyl group having not more than 15 carbon atoms.

This timing group connects with the coupling position of the coupler residue at Y, which is the case in the general formula XV.

Next example of the timing group which releases a development inhibitor group by intra-molecular nucleophilic substitution reaction is represented by the general formula XVII:

—Nu—$X_1$—E— General Formula XVII wherein Nu is a nucleophilic group having an oxygen atom, a sulfur atom or a nitrogen atom, which has rich electrons and is connected to the coupling position of a coupler residue; E is an electrophilic group having a carbonyl group, a thiocabonyl group, a phosphinyl group or a thiophosphinyl group, which has insufficient electrons and is connected with A. $X_1$ is a linking group, which links Nu and E stereochemically and is subject to intra-molecular nucleophilic reaction accompanying the formation of 3 to 7 membered cycle after Nu is released from the coupler residue, whereby A is released.

The general formula I is explained.

In the general formula I, $L_1$ represents a mere linkage or a divalent linking group. As for the linking group, an alkylene group, an arylene group and a divalent heterocyclic group are preferable.

In the general formula I, when $L_1$ represents an alkylene group, it may contain an oxygen atom, a nitrogen atom or a sulfur atom in the middle of its main carbon chain. As for the alkylene group, for example, methylene group, ethylene group, pentamethylene group, etc. can be mentioned.

Preferable alkylene group is one containing not more than 12 carbon atoms. Especially preferable alkylene group is methylene group, ethylene group, or methylmethylene group.

As for the arylene group represented by $L_1$, for example, a substituted or unsubstituted phenylene group, naphthylene group, etc. can be mentioned, and , particularly, phenylene group is preferable.

As for the divalent heterocyclic group, furane-di-il group, thiophen-di-il group, thiadiazole-il group, etc. may be mentioned.

Among those groups represented by $L_1$, preferable one is a mere linkage or an alkylene group.

In the general formula I, the group represented by $R^1$includes, for example an alkyl group such as methyl group, ethyl group, propyl group, iso-propyl group, butyl group, secbutyl group, hexyl group, etc.; a cycloalkyl group such as cyclopentyl group, cyclohexyl group, etc.; an aryl group such as phenyl group, naphthyl group, etc.; a heterocyclic group such as pyridinyl group, imidazolyl group, pyrrolyl group, etc. These groups may have a substituent, including, for example, a halogen atom, a nitro group, a cyano group, an alkyl group, an alkenyl group, a cycloalkyl group, an aryl group, an alkoxy group, an aryloxy group, an alkoxycarbonyl group, an aryloxycarbonyl group, a sulfo group, sulfamoyl group, a carbamoyl group, an acylamino group, a ureido group, a urethane group, a sulfonamide group, a heterocyclic group, an arylsulfonyl group, an alkylsulfonyl group, an arylthio group, an alkylthio group, an alkylamino group, an anilino group, a hydroxyl group, an imide group and an acyl group, preferable one as $R^1$ is an alkyl group.

$R^2$ in the general formula I represents a hydrogen atom or a substituent thereof. As for examples of the substituent, the same atoms and groups mentioned as to the substituent for $R^1$ can be mentioned.

In the general formula I, preferable combinations of n and m are n=1 and m=2, and n=2 and m=1, particularly preferably, n is two and m is one. When n and m are respectively two or more, the plurality of —$L_1$OOC—$R^2$ and $R^2$ may be either same or different.

Representative examples of compounds are shown below.

No. DI

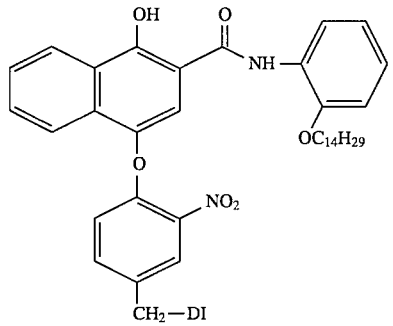

1

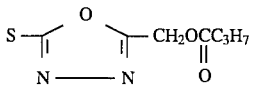

2

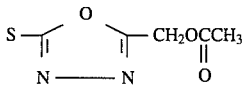

3

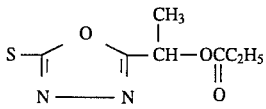

4

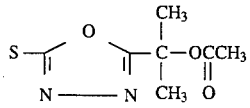

5

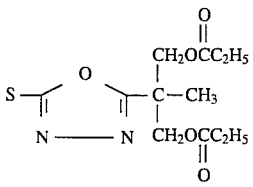

6

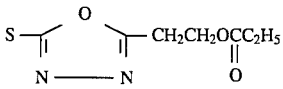

7

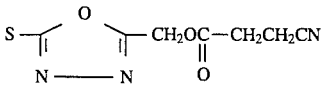

-continued
| No. | DI |
|---|---|
| 8 | 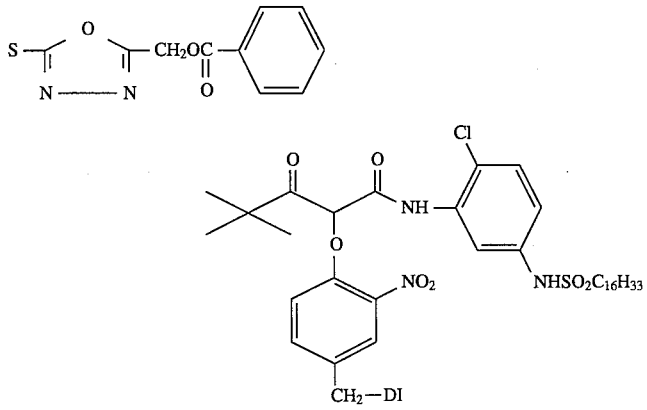 |
| 9 | 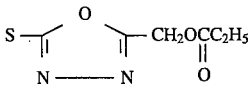 |
| 10 | 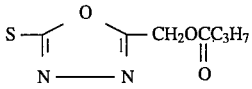 |
| 11 | 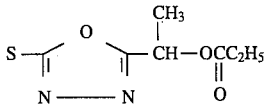 |
| 12 | 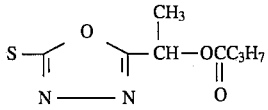 |
| 13 | 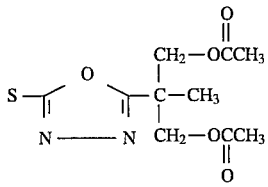 |
| 14 | 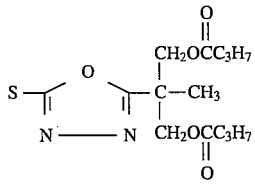 |
| 15 | 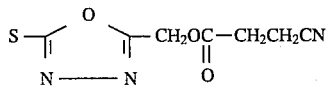 |
| 16 | 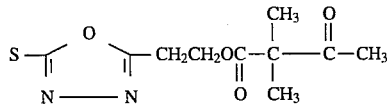 |

-continued
| No. | DI |
|---|---|
| 17 | 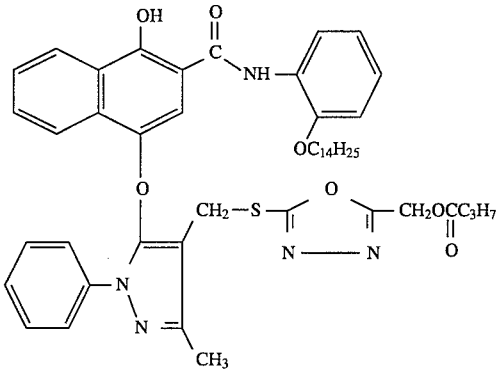 |
| 18 | 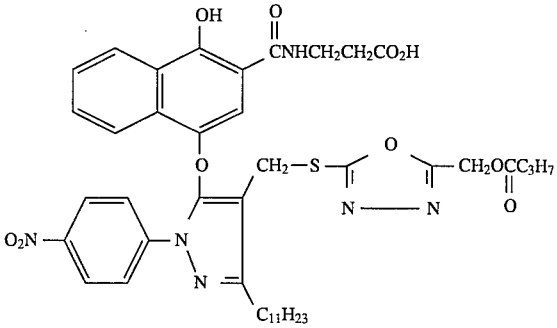 |
| 19 | 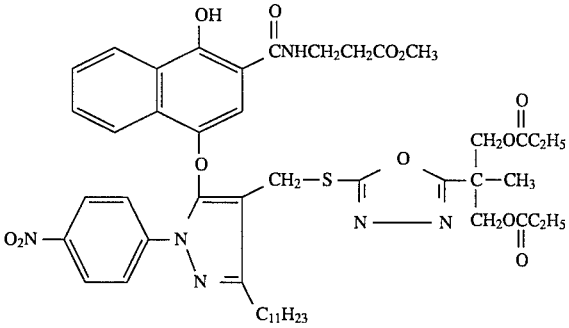 |
| 20 | 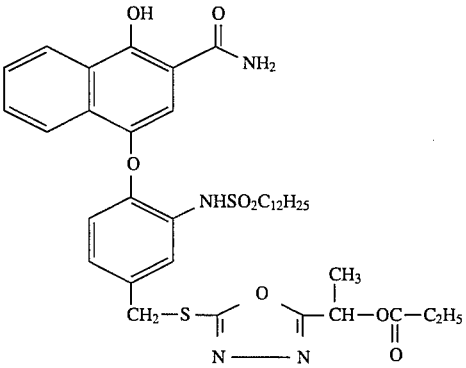 |

-continued
| No. | DI |
|---|---|
| 21 | 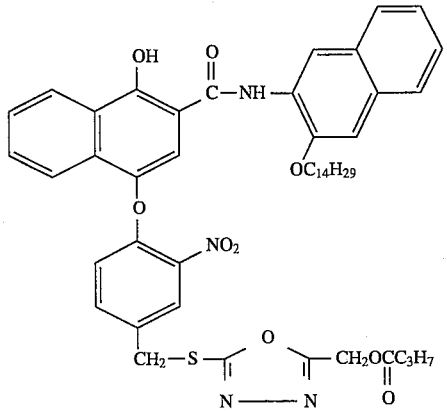 |
| 22 | 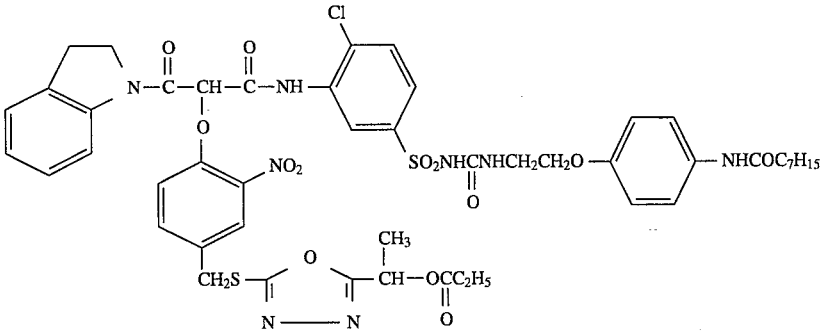 |
| 23 | 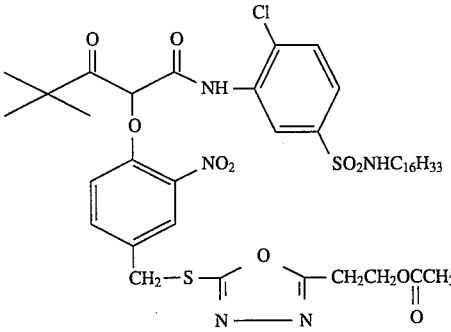 |
| 24 | 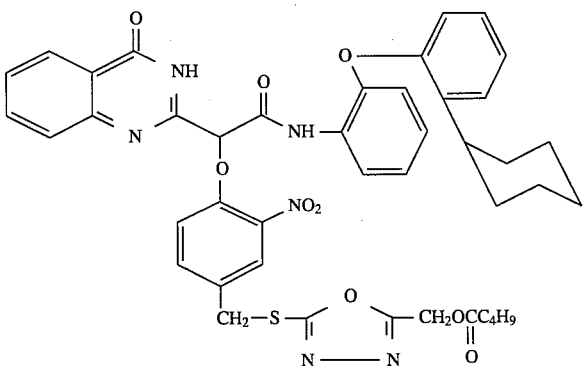 |

-continued
| No. | DI |
|---|---|
| 25 | 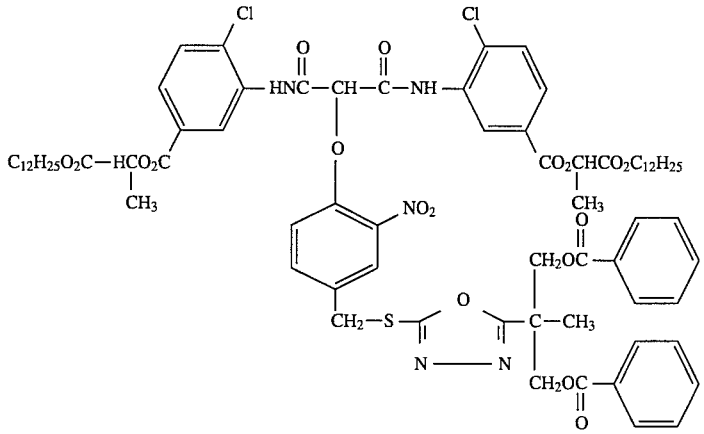 |
| 26 | 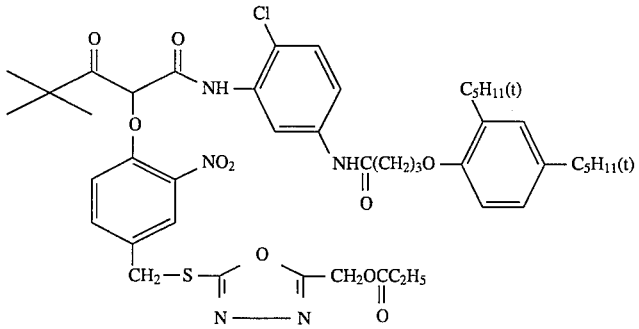 |
| 27 | 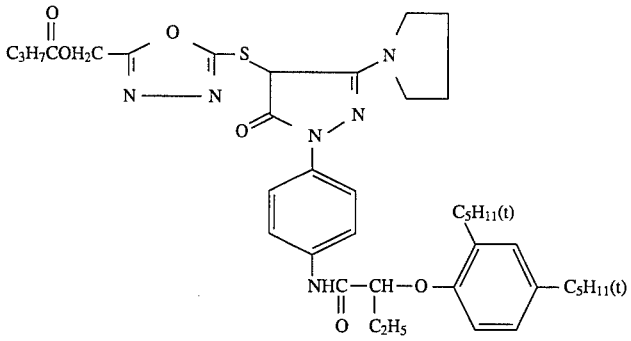 |
| 28 | 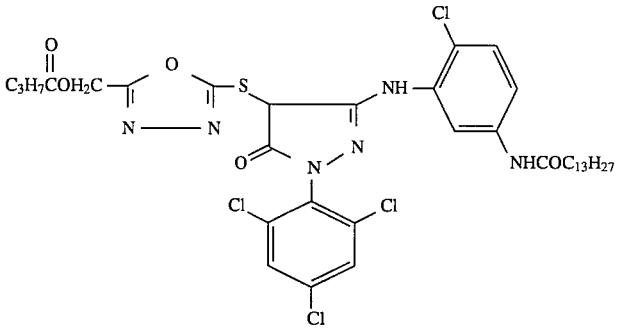 |

-continued

| No. | DI |
|---|---|
| 29 | 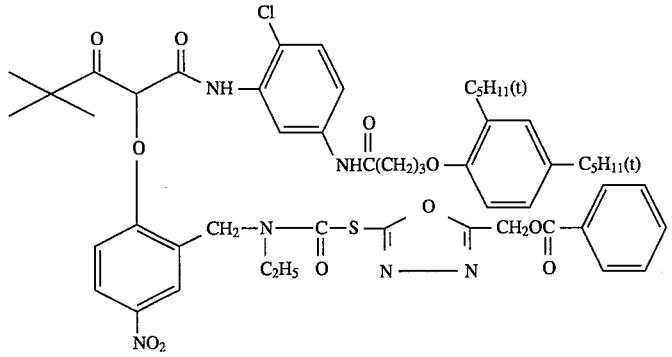 |

Hereinbelow, representative synthesis of the compounds of the used in the present invention are given.

Synthesis Example 1

Synthesis of Exemplified Compound 2

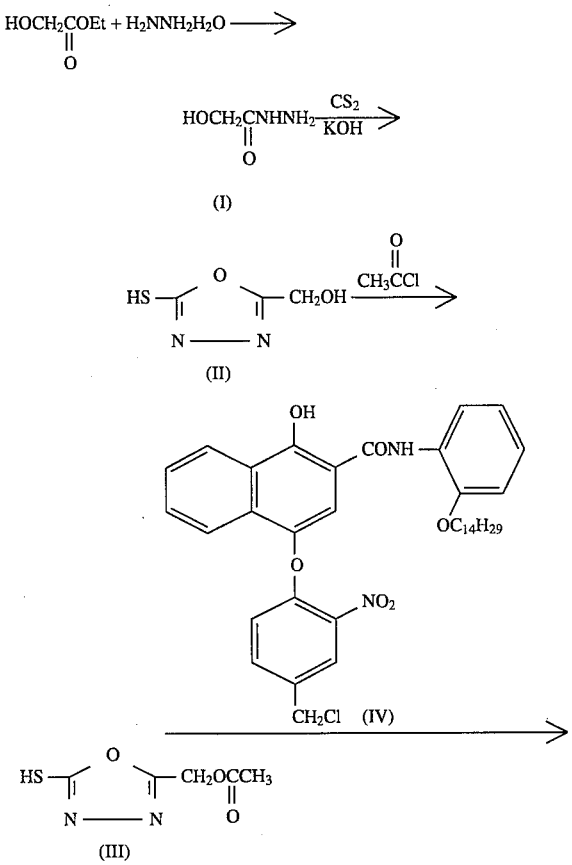

Exemplified Compound 2

(1) Synthesis of Compound (I)

46.5 g of ethylglycolate and 24.6 g of hydrazine monohydrate were dissolved in 250 ml of ethanol and the solution was agitated for three hours under heat reflux. After reaction was completed, the ethanol was distilled off under reduced pressure, to obtain 40.3 g of white crystal, i.e., Compound (I). This was used for the next procedure without refinement.

(2) Synthesis of Compound (II)

30.0 g of Compound(I) was dissolved in 300 ml of ethanol and to this 22.8 g of potassium hydroxide dissolved in 90 ml of water was added. Then, 26.6 g of carbon disulfide was added dropwise. After agitation for 30 minutes under the room temperature, reaction was continued for twelve hours under heat reflux. Then after distilling off ethanol, 200 ml of water was added to the residue and insoluble product was filtered. After the aqueous solution was made acidic by adding hydrochloric acid, extraction was conducted with ethyl acetate. After distilling out the ethylacetate, residual on distillation was re-crystalized in a mixed solvent of acetonitrile-methylene chloride, thus to obtain 16.7 g of Compound (II).

(3) Synthesis of Compound (III)

16.5 g of Compound(II) was dissolved in 250 ml of ethyl acetate and, to this, 20.8 g of pyridine was added. Under cooling with ice, 20.6 g of acetyl chloride dissolved in 75 ml of ethyl acetate was added dropwise. After agitating the solution for two hours under the room temperature, hydrochloric salt of pyridine produced was separated by filtration. To the obtained ethylacetate solution, 10% by weight, aqueous solution of potassium carbonate was added and the solution was violently agitated for 30 minutes. After the solution was made acidic with hydrochloric acid, the solution was separated and after organic layer was dried with magnesium sulfide, this was concentrated under reduced pressure. By recrystalizing the residual from a mixed solvent of methylenechloride-hexane, 13.1 g of Compound (III) was obtained.

(4) Synthesis of Exemplified Compound 2

15.8 g of Compound III and 31.5 g of Compound IV were dissolved in 250 ml of dimethylformamide and, to this solution, 11.5 g of tetramethyl guanidine was added and the solution was agitated for three hours at the room temperature. After completion of the reaction the reactant solution was added to water. Then after extraction with ethyl acetate, washed with a 5% by weight of aqueous solution containing sodium carbonate and, then, with dilute hydrochloric acid.

Organic layer was dried using magnesium sulfide and the solvent was distilled out. Residue on distillation was refined by silica gel chromatography with an ethylacetatehexane mixed solvents as a developing solution, to obtain 22.1 g of Exemplified Compound 2. The compound was identified as the objective compound by N.M.R., I.R. and mass spectrometric analyses.

D.I.R. coupler used in the present invention may be incorporated in any optional layer of the photographic material, e.g., silver halide emulsion layer and/or non-light-sensitive hydrophilic colloidal layer. However, it is preferable to incorporate in the silver halide emulsion layer. Still more preferably, it is incorporated in the red-sensitive silver halide emulsion layer and/or green-sensitive silver halide emulsion layer.

In order to incorporate the D.I.R. coupler used in the present invention in the hydrophilic colloidal layer of a light-sensitive color photographic layer, it is possible to apply a method, in which the coupler is first dissolved in a conventionally known high boiling-point solvent, such as dibutyl phthalate, tricresyl phosphate, di-nonylphenol, etc., or combination of the high boiling-point solvent and a low boiling-point solvent such as butyl acetate, propionic acid, etc. either singly or in combination, respectively. Then the coupler solution is mixed with an aqueous solution containing gelatin and a surface active agent. Subsequently, after the solution is subject to emulsification, using a high-speed rotary mixer, a colloid mill or a ultra-sonic homogenize, this is incorporated in the emulsion, either directly or after it being is set, cut and washed with water.

The amount of the D.I.R. coupler to be used in the present invention is generally between 0.0005 and 5.0 mols a mol of silver halide and, more preferably, between 0.005 and 1,0 mol.

The D.I.R. coupler used in the present invention may be used either singly or two or more kinds in combination.

As for silver halide emulsion used in the light-sensitive material of the present invention, any kind of silver halide emulsion which is known in the art can optionally be employed. The emulsion may undergo a conventional chemical sensitization, and can be spectrally sensitized with a conventional sensitizing dye, to make the emulsion sensitive to lights of any pre-designed spectral region.

The silver halide emulsion can comprise one or more kinds of photographic additives such as an anti-foggant, a stabilizer, etc. As for the binder for the emulsion, it is advantageous to use gelatin.

The silver halide emulsion layer and other hydrophilic colloidal layer may be hardened and comprise a plasticizer and a dispersion containing a polymer which is insoluble or sparsely soluble in water.

Dye-forming coupler is used in the silver halide emulsion layer of the light-sensitive color photographic material of the present invention.

It is also possible to use a colored coupler which functions as a color compensator, a competing coupler, a compound which is, upon reaction with an oxidation product of a color developing agent capable of releasing a photographically useful fragment such as a development accelerator, a bleach accelerator, a developing agent, a solvent for the silver halide, a color toning agent, a hardener, a fogging agent, an anti-foggant, a chemical sensitizer, a spectral sensitizer, a desensitizing agent, etc.

The light-sensitive photographic material of the present invention may comprise any optional auxiliary layer such as a filter layer, an anti-halation layer, an anti-irradiation layer, etc. These layers and/or the silver halide emulsion layer may contain a dye, which either flows out of the photographic material or is capable of being bleached during development process.

Further, the light-sensitive material can comprise other photographic additive such as a matting agent, a lubricant, an image-stabilizer, a surface active agent, an anti-color foggant, a development accelerator, a development retarding agent and a bleach accelerator.

As for the support, for example, paper laminated with a polymer such as polyethylene, a polyethyleneterephthalate film, a baryta paper and a cellullose triacetate may be used.

In order to obtain a dye image using the light-sensitive material of the present invention, color photographic process which is generally known in the art may be applied.

EXAMPLES

Hereinbelow the present invention is further explained with reference to working examples.

In all of the following examples, the amount of addition of the additive in the silver halide light-sensitive photographic material is given, unless defined otherwise, in terms of weight a square meter of the light-sensitive material.

Example 1

On a triacetylcellullose film support, respective layers, the components of which are given below, are provided in order, to prepare multi-layer silver halide light-sensitive photographic material (Sample No. 10.

First Layer: Anti-Halation Layer(HC-1)

A gelatin layer containing black colloidal silver

Second Layer: Intermediate Layer(IL)

A gelatin layer containing emulsified 2,5-di-t-octyl hydroquinone.

Third Layer: Low red light-sensitive silver halide emulsion layer

A monodisperse emulsion containing AgBrI crystals, of which average grain size and AgI content are 0.30 μm and 6 mol %, respectively.

| (Emulsion I) | 1.8 g |
|---|---|
| Sensitizing Dye I | $6 \times 10^{-5}$ mols a mol of silver |
| Sensitizing Dye II | $1 \times 10^{-5}$ mols a mol of silver |
| Cyan Dye-Forming Coupler (C-1) | 0.006 mols a mol of silver |
| Colored cyan Coupler (CC-1) | 0.003 mols a mol of silver |
| DIR Compound (D-1) | 0.0035 mols a mol of silver |

Fourth Layer: High red light-sensitive silver halide emulsion layer

A mono-disperse emulsion containing AgBrI crystals, of which average grain size and AgI content are 0.5 μm and 7 mol %, respectively.

| | 1.3 g |
|---|---|
| Sensitizing Dye I | $3 \times 10^{-5}$ mols a mol of silver |
| Sensitizing Dye II | $1 \times 10^{-5}$ mols a mol of silver |
| Cyan Dye-Forming Coupler (C-1) | 0.02 mols a mol of silver |
| Colored cyan Coupler (CC-1) | 0.0015 mols a mol of silver |
| DIR Compound (D-1) | 0.001 mols a mol of silver |

Fifth Layer: Intermediate Layer(IL)

A gelatin layer same as Layer 2.

Sixth Layer: Low green light-sensitive silver halide emulsion layer (GL-1)

A mono-disperse emulsion containing AgBrI crystals, of which average grain size and AgI content are 0.30 μm and 6 mol %, respectively.

| (Emulsion I) | 1.5 g |
|---|---|
| Sensitizing Dye III | $2.5 \times 10^{-5}$ mols a mol of silver |
| Sensitizing Dye IV | $1 \times 10^{-5}$ mols a mol of silver |
| Magenta Dye-Forming Coupler (M-1) | 0.050 mols a mol of silver |
| Colored Magenta Coupler (CM-1) | 0.009 mols a mol of silver |
| DIR Compound(D-1) | 0.0010 mols a mol of silver |
| DIR Compound(D-3) | 0.0030 mols a mol of silver |

Seventh Layer: High green light-sensitive silver halide emulsion layer (GH-1)

| (Emulsion II) | 1.4 g |
|---|---|
| Sensitizing Dye III | $1.5 \times 10^{-5}$ mols a mol of silver |
| Sensitizing Dye IV | $1.0 \times 10^{-5}$ mols a mol of silver |
| Magenta Dye-Forming Coupler (M-1) | 0.020 mols a mol of silver |
| Colored Magenta Coupler (CM-1) | 0.002 mols a mol of silver |
| DIR Compound (D-3) | 0.0010 mols a mol of silver |

Eighth Layer: Yellow Filter Layer(YC-1)

A gelatin layer containing yellow colloidal silver and an emulsified product of 2,5-di-t-octylhydroquinone Ninth Layer: Low blue light-sensitive silver halide emulsion layer(BL-1)

A mono-disperse emulsion containing AgBrI crystals, of which average grain size and AgI content are 0.48 μm and 6 mol %, respectively.

| (Emulsion III) | 0.9 g |
|---|---|
| Sensitizing Dye V | $1.3 \times 10^{-5}$ mols a mol of silver |
| Yellow Dye-Forming Coupler (Y-1) | 0.29 mols a mol of silver |

Tenth Layer: High blue light-sensitive silver halide emulsion layer(BH-1)

| (Emulsion IV) | 0.5 g |
|---|---|
| Sensitizing Dye V | $1 \times 10^{-5}$ mols a mol of silver |
| Yellow Dye-Forming Coupler (M-1) | 0.08 mols a mol of silver |
| DIR Compound (D-2) | 0.0015 mols a mol of silver |

Eleventh Layer: First protective layer

A gelatin layer containing AgI crystals, of which AgI content and average grain size are 1 mol % and 0.07 μm, respectively.

Twelfth Layer: Second Protective Layer

A gelatin layer containing polymethylmethacrylate grains (Diameter=1.5 μm) and a formalin scavenger(HS-1)

Respective layers contain, in addition to those components mentioned above, a gelatin hardener and a surface active agent.

Compounds contained in the respective layers of Sample 1 are as follows:

Sensitizing Dye I; Anhydro-5,5'-dichloro-9-ethyl-3,3'-di-(3-sulfopropyl)thiacarbocyanine hydroxide Sensitizing Dye II; Anhydro-9-ethyl-3,3'-di-(sulfopropyl)-4,5,4',5'-dibenzthiacarbocyanine hydroxide Sensitizing Dye III; Anhydro-5,5'-di-phenyl-9-ethyl-3,3'-di-3-sulfopropyl)oxacarbocyanine hydroxide Sensitizing Dye IV; Anhydro-9-ethyl-3,3'-di-(3-sulfopropyl)-5,6,5',6'-dibenzoxacarbocyanine hydroxide Sensitizing Dye V; Anhydro-3,3'-di-(3-sulfopropyl)-4,5-benz-5'-methoxy thiacarbocyanine hydroxide (Compound disclosed in Japanese Patent O.P.I. Publication No.63–27701(1988))

D-1

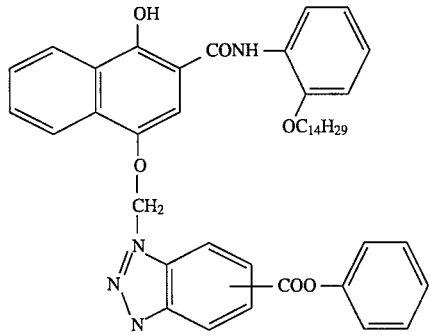

-continued
D-2
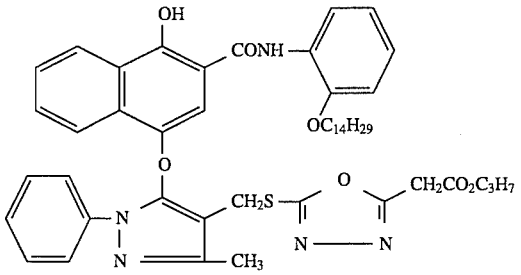
(Compound disclosed in U.S. Pat. No. 4,782,012)
D-3
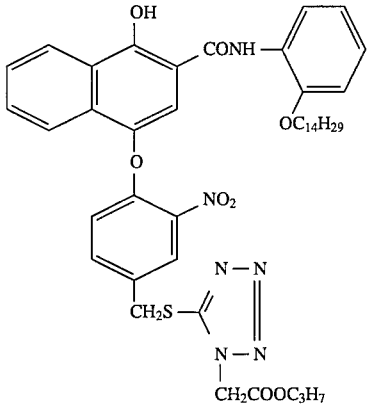
C-1, C-2
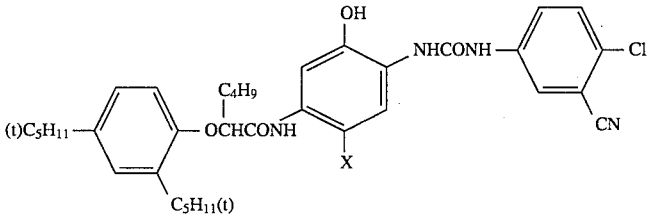
C-1 X=H
C-2 X=$OCH_2COOCH_3$
CC-1
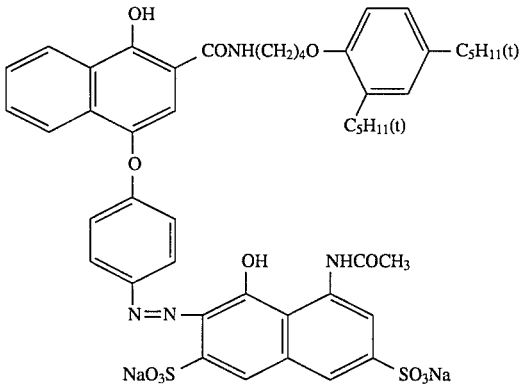
M-1
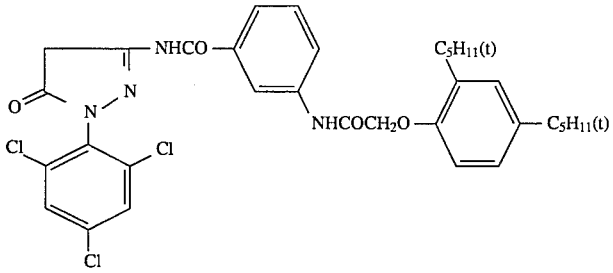

-continued

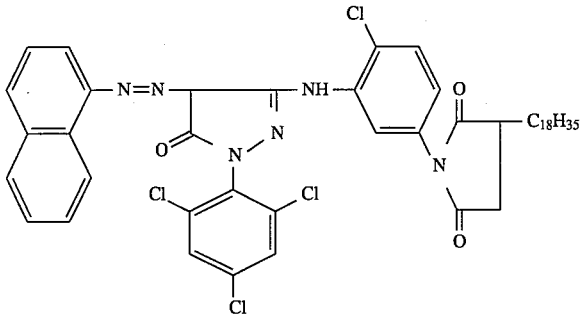

CM-1

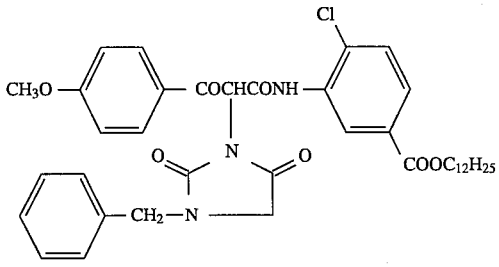

Y-1

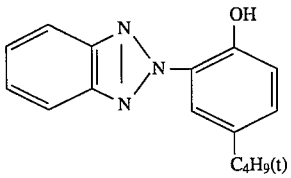

UV-1

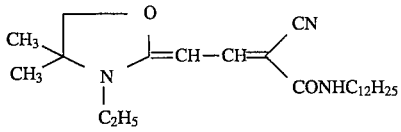

UV-2

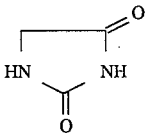

HS-1

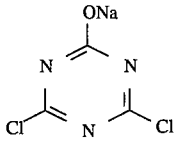

H-1

Moreover, Samples No. 2 through 8 were prepared in the same manner as Sample No. 1, provided than in these samples, equivalent molor amount of DIR compounds as shown in Table 1 were used in place of DIR Compound (D-1) in the third and fourth layers of Sample 1.

A part of the respective Samples No. 1 through 8 were placed for seven days under atmospheric conditions of 55° C. and 20% R.H., samples which have not undergone the above-mentioned process and those that undergone the process were subjected to exposure to white light through an optical wedge and sensitivity and fog of the red-sensitive layer were measured.

Additionally, measurement of image sharpens was carried out. Sharpness was shown in terms of relative MTF Value at the spatial frequency at 30 lines/mm, when MTF of Sample 1 is normalized as 100.

Results are shown in Table-1.

| processing Steps (38° C.) | |
|---|---|
| Color Development | 3 minutes 15 seconds |
| Bleach | 6 minutes 30 seconds |
| Washing | 3 minutes 15 seconds |
| Fixing | 6 minutes 30 seconds |
| Rinsing | 3 minutes 15 seconds |
| Stabilizing | 1 minute 30 seconds |
| Drying | |

Ingredients in the respective processing solutions used in the respective processes are as follows:

| [Color Developing Solution] | |
|---|---|
| 4-Amino-3-methyl-N-ethyl-N-β-hydroxyethylaniline sulfate | 4.75 g |
| Sodium sulfite anhydrite | 4.25 g |
| Hydroxylamine ½sulfate | 2.0 g |
| potassium carbonate anhydrite | 37.5 |
| Sodium bromide | 1.3 g |
| Trisodium nitrilo-triacetate | 2.5 g |
| Potassium hydroxide | 1.0 g |
| Add water to make the total volume 1 liter and adjusted pH at 6.0 with aqueous ammonia. | |
| [Bleaching Solution] | |
| Ammonium ferric (III) ethylenediaminetetracetic acid | 100 g |
| Diammonium ethylenediamineteracetic acid | 10.0 g |
| Ammonium bromide | 150.0 g |
| Acetic acid | 10 ml |
| Add water to make the total volume 1 liter and adjusted pH of the solution with annmonia water. | |
| [Fixing Solution] | |
| Ammonium thiosulfate | 175.0 g |
| Sodium thiosulfate anhydrite | 8.5 g |
| Sodium metasulfate | 2.3 g |
| Add water to make the total volume one liter and adjusted pH of the solution at 6.0 with acetic acid | |
| [Stabilizing Solution] | |
| Formalin (37% aqueous solution) | 1.5 ml |
| Konidax (a product of Konica Corporation) | 7.5 ml |
| Add water to make the total volume one liter. | |

TABLE 1

| Sample No. | DIR Compound used in 3rd and 4th layers | Un-processed Sensitivity | Un-processed Fog | Processed at 55° C. Sensitivity | Processed at 55° C. Fog | Sharpness |
|---|---|---|---|---|---|---|
| 1 | D-1 | 100 | 0.16 | 92 | 0.30 | 100 |
| 2 | D-2 | 98 | 0.16 | 93 | 0.28 | 104 |
| 3 | D-3 | 99 | 0.16 | 93 | 0.31 | 101 |
| 4 | 1 | 99 | 0.16 | 98 | 0.19 | 114 |
| 5 | 2 | 102 | 0.14 | 99 | 0.18 | 112 |
| 6 | 3 | 100 | 0.15 | 98 | 0.18 | 113 |
| 7 | 5 | 101 | 0.14 | 99 | 0.17 | 115 |
| 8 | 17 | 99 | 0.14 | 98 | 0.19 | 112 |

It is obvious from Table 1 that according to the present invention, a silver halide light-sensitive color photographic material, which is capable of producing a dye image having enhanced image-sharpness, showing large inter-image effect with reduced reduction of gamma in the layer, to which the coupler is incorporated and having improved stability with the lapse of time during storage, is obtained.

Example 2

On a triacetate film support the following layers were coated in the following order, to prepare a basic Sample.

(1) A red-sensitive silver iodobromide emulsion layer comprising 0.5 g of C-2 as a cyan dye-forming coupler, 2.4 g of gelatin and 1.6 g of silver halide.

(2) An intermediate layer comprising 0.5 g of gelatin and 0.1 g of 2,5-di-t-octylhydroquinone.

(3) A blue-sensitive silver iodobromide emulsion layer comprising 1,70 g 0f Y-1 as a yellow dye-forming coupler and 1.6 g of silver halide.

A protective layer comprising 0.8 g 0f gelatin.

Among above-mentioned constituent layers of the basic sample, DIR couplers as shown in Table 2 were incorporated in the third layer, thus to prepare seven Samples No. 9. through 15.

The respective samples were divided into two groups and one of them were subjected to exposure to white light and the other to red light through an optical wedge.

Next, they were processed in the same manner as in Example 1.

With respect to respective Samples, gamma(γ) values were obtained from the characteristic curves of the cyan images obtained by color development and values (γR/γW), which is a ratio of gamma value by exposure with red light and the same by the exposure with white light, were obtained. Results are shown in Table 2.

TABLE 2

| Sample No. | DIR Compound | γR/γW |
|---|---|---|
| 9 | D-4 | 1.20 |
| 10 | D-5 | 1.22 |
| 11 | D-6 | 1.24 |
| 12 | 9 | 1.45 |
| 13 | 10 | 1.43 |
| 14 | 13 | 1.47 |
| 15 | 23 | 1.43 |

D-4 (compounds disclosed in Japanese Patent publication No. 53-27701(1988)

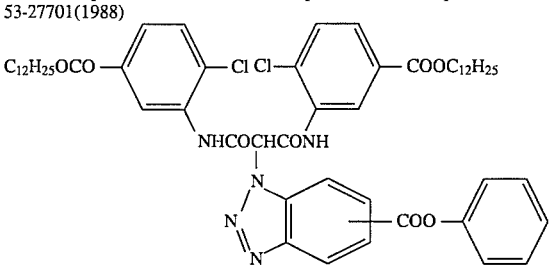

D-5 (Compounds disclosed in U.S. Pat. No. 4,782,012)

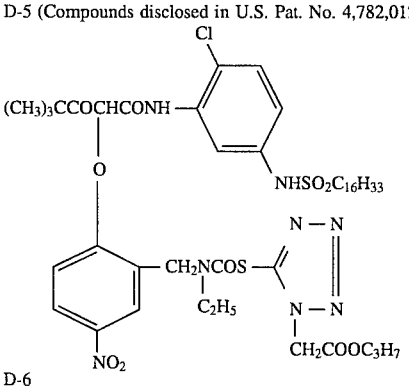

D-6

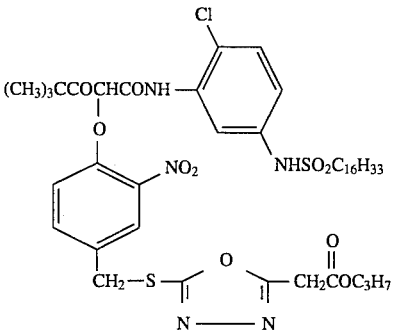

It is obvious from Table 2 that the samples, to which compounds according to the present invention are incorporated, show relatively large γR/γW values, revealed that relatively larger intra-layer effect in comparison with the samples in which a DIR coupler of the prior art is employed.

Further, gamma values in the blue-sensitive layer are greater than those of the comparative samples.

According to the present invention, it is possible to provide to a silver halide light-sensitive color photographic material which is capable of producing a dye image having enhanced image-sharpness, showing large inter-layer image effect with reduced reduction of gamma in the layer, to which the coupler is incorporated and having improved stability with the lapse of time during storage.

We claim:

1. A silver halide light-sensitive color photographic material having a silver halide emulsion layer, provided on a support, comprising a compound which releases, upon reaction with an oxidation product of a color developing agent, a 2-mercapto-1,3,4-oxadiazole derivative represented by formula I:

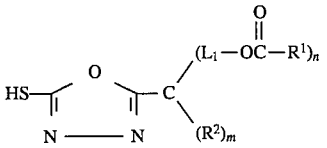

I the compound being a yellow or cyan dye forming coupler represented by formula

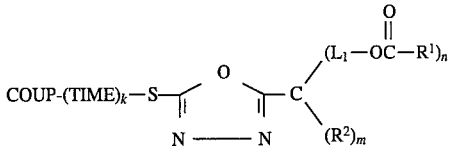

wherein $L_1$ represents a linkage or a divalent linking group; $R^1$ represents an alkyl group, an aryl group or a heterocyclic group; $R^2$ represents a hydrogen atom or a substituent; n represents an integer of one, two or three; and m represents an integer of zero, one or two, provided that sum of m and n is three; COUP is a group coupling with an oxidation product of a color developing agent, TIME is a group which releases 2-mercapto-1,3,4-oxadiazole derivative represented by formula upon reaction that an oxidation product of a color developing agent couples with COUP, k is 0 or 1.

2. A silver halide light-sensitive color photographic materials of claim 1, wherein $R^1$ is an alkyl or aryl group.

3. A silver halide light-sensitive color photographic materials of claim 1, wherein $R^2$ is a hydrogen atom, an alkyl or aryl group.

* * * * *